US005778999A

United States Patent [19]

Nealeigh

[11] Patent Number: 5,778,999

[45] Date of Patent: Jul. 14, 1998

[54] SCAFFOLD EXTENSION AND ENCLOSURE SYSTEM

[76] Inventor: Dustin L. Nealeigh, 527 Markwith, Greenville, Ohio 45331

[21] Appl. No.: 813,407

[22] Filed: Mar. 10, 1997

[51] Int. Cl.[6] ..... E04G 1/26

[52] U.S. Cl. ..... 182/82; 182/129; 182/138

[58] Field of Search ..... 182/129, 138, 182/82

[56] References Cited

U.S. PATENT DOCUMENTS

| | | | |
|---|---|---|---|
| 3,566,991 | 3/1971 | Proulx | 182/129 |
| 3,630,314 | 12/1971 | Bamburg | 182/178.5 |
| 3,995,715 | 12/1976 | Virtanen | 182/129 |

FOREIGN PATENT DOCUMENTS

| | | | |
|---|---|---|---|
| 290132 | 4/1914 | Germany | 182/82 |
| 27253 | 11/1964 | Germany | 182/138 |
| 2909727 | 9/1980 | Germany | 182/129 |
| 4318678 | 12/1993 | Germany | 182/222 |
| 406146572 | 5/1994 | Japan | 182/222 |

*Primary Examiner*—Alvin C. Chin-Shue
*Attorney, Agent, or Firm*—Jacox, Meckstroth & Jenkins

[57] ABSTRACT

A series of horizontally spaced tubular metal frames each include a pair of vertical short and long leg members rigidly connected by an inclined support member having a projecting upper end portion. The leg members are removably connected to the top ends of vertically aligned legs of a tubular metal scaffold assembly positioned adjacent a building. The inclined support members receive connector members connected to the building roof or ridge members connected by horizontal support members and supported by vertical posts resting on the roof or floor. A flexible light transmitting plastic film is supported by the inclined support members and ridge connector members to enclose the frames and scaffold assembly, and the film has an edge portion clamped to the roof or floor.

7 Claims, 3 Drawing Sheets

SCAFFOLD EXTENSION AND ENCLOSURE SYSTEM

BACKGROUND OF THE INVENTION

In the construction of a building which may be a commercial building or a residential building, it is frequently desirable to construct or finish the exterior walls of the building when the weather is not suitable for working due to rain, snow, wind and/or low temperatures. Also, when the outer walls require plastering or stuccoing or the application of other exterior surface materials, it is desirable for the air adjacent the exterior walls to be dry and above a certain minimum temperature. It is also desirable for the workmen to be protected from the weather elements and sometimes to work within a heated space.

It is common to erect or assemble a modular or sectional scaffold system exterior of the building and adjacent the outer walls, especially for a multiple level or story building. Usually, the scaffold assembly includes preconstructed and stackable bridge-like frames each of which has parallel spaced vertical legs rigidly connected by a horizontal cross member. Horizontally spaced pairs of scaffold frames are rigidly connected at each level by X-shaped cross members which are releasably secured by bolts to the legs of the scaffold frames. Sometimes, the scaffold assembly is covered by a transparent or translucent plastic film material, and the upper edge portion of the cover film is attached to the wall or roof of the building.

Wood 2×4's or other wood strips are commonly positioned to bridge over the top of the scaffold assembly and over the gap between the scaffold assembly and the building to support the plastic film for forming an enclosed space which may be heated with space heaters. The scaffold assembly may also be covered by removable panels of plastic film material, for example, as disclosed in U.S. Pat. No. 5,038,889, or the plastic film enclosure may be supported by a structure which rests on a floor of the building being constructed, for example, as disclosed in U.S. Pat. No. 3,007,541.

SUMMARY OF THE INVENTION

The present invention is directed to an improved protective enclosure system for mounting on a scaffold assembly positioned adjacent a building. The enclosure system is economical and light weight in construction, provides for depositing rain water and snow on the ground outboard of the scaffold assembly, protects against wind and direct sunlight and provides for temporary heating of an enclosed space. The enclosure system of the invention is also flexible and expandable to accommodate different types of buildings, such as buildings with a flat roof or a pitch roof. In addition, the enclosure system ties the scaffold assembly to the building for stabilizing the scaffold assembly and may be easily assembled and disassembled for convenient transporting and storage.

The above features and advantages are generally provided by an enclosure system which includes a series of horizontally spaced tubular metal frames each including a set of vertical short and long leg members rigidly connected by an inclined support member having a projecting upper end portion. The leg members are vertically aligned and releasably coupled to the top ends of the legs of a tubular metal scaffold assembly which is positioned adjacent a building. The inclined support members receive tubular connecting members secured to the building roof or receive tubular ridge members which are connected by horizontal support members and are supported by vertical posts mounted on the roof. A flexible light transmitting plastic film cover is supported by the metal frames and connecting members to enclose the frames and scaffold assembly, and the film cover has an upper edge portion which is clamped to the roof.

Other features and advantages of the invention will be apparent from the following description, the accompanying drawings and the appended claims.

DESCRIPTION OF THE PREFERRED EMBODIMENTS

Figure 1:
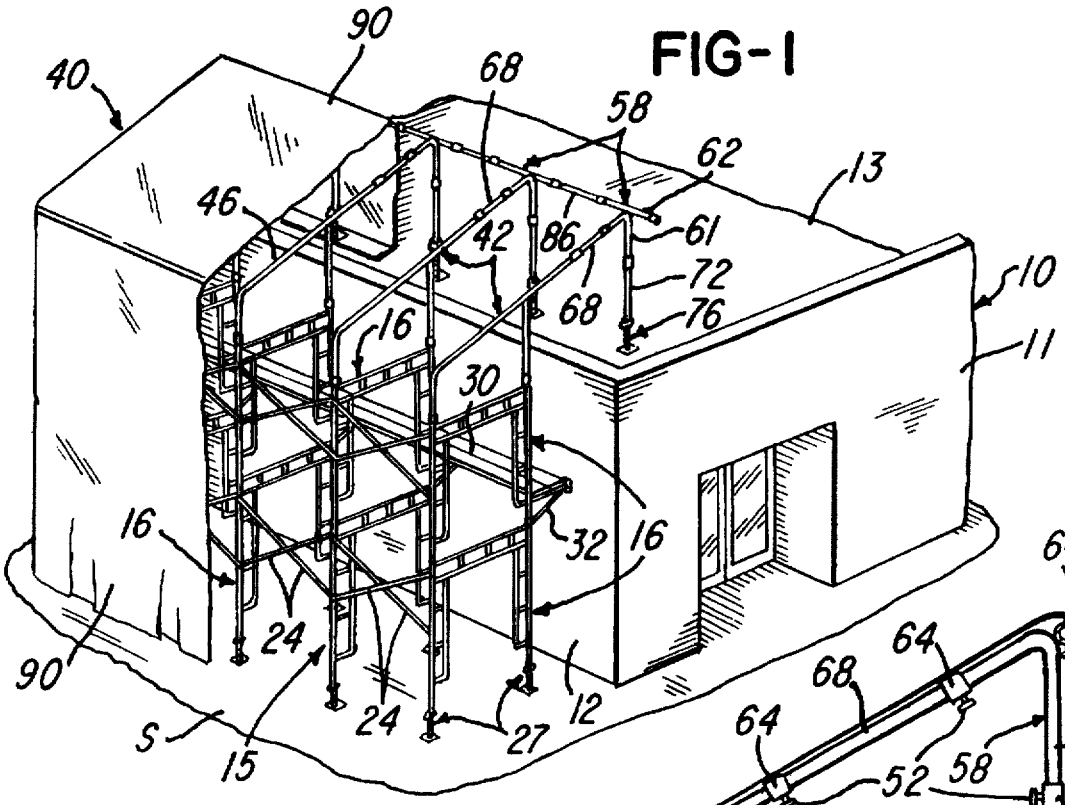
FIG. 1 is a perspective view of a scaffold assembly positioned adjacent a building and supporting an enclosure system constructed in accordance with the invention, and with a portion of a protective plastic film cover broken away.
Figure 2:
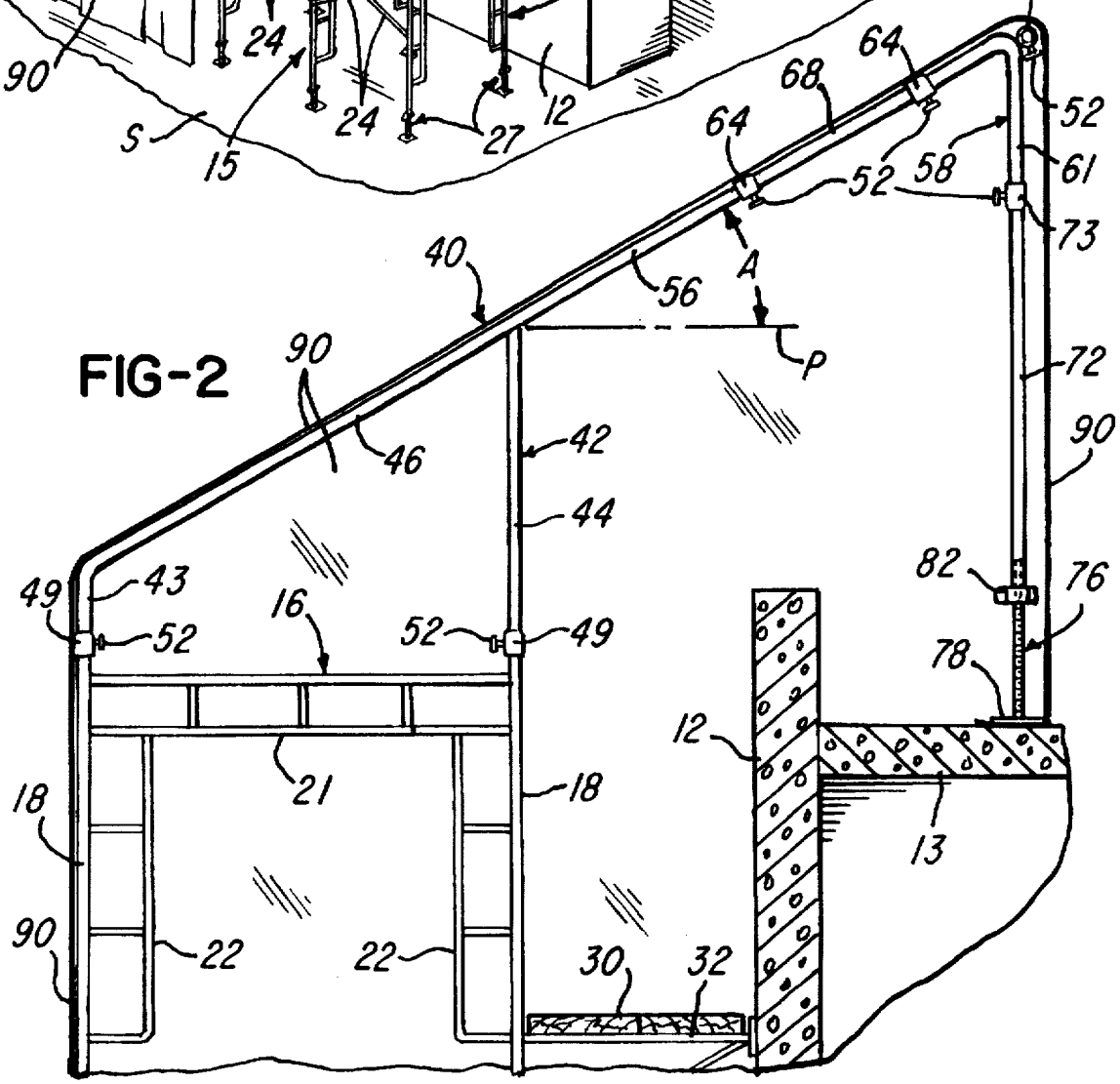
FIG. 2 is a fragmentary end elevational view of the scaffold assembly and enclosure system shown in FIG. 1.

FIG. 1 illustrates a commercial building 10 including a front wall 11, a side wall 12 and a flat roof 13 which may be constructed of hollow core concrete panels or by conventional roofing materials supported by generally horizontal trusses. The building 10 may also be a multiple story building with an intermediate floor 13 and with the side wall 12 being progressively constructed, for example, with modular blocks and/or bricks. As also shown in FIG. 1, a conventional modular scaffold assembly 15 is erected adjacent the building wall 12, and the assembly commonly includes a series of horizontally spaced scaffold units 16 each of which has an inverted U-shaped configuration and is constructed of steel tubing. A typical scaffold unit 16 is shown in FIG. 2 and includes horizontally spaced vertical tubular steel legs 18 rigidly connected by a tubular steel horizontal truss 21 and reinforced by tubular steel ladder sections 22 which are all welded together to form a rigid bridge-like scaffold unit.

As shown in FIG. 1, the scaffold units 16 are adapted to be stacked to form multiple tiers, and laterally adjacent pairs of scaffold units 16 are rigidly connected by crossing steel frame members 24 which are removably connected to the scaffold units by bolts. The legs 18 of the bottom scaffold units 16 are provided with adjustable screw jacks 27 for leveling the scaffold assembly 15 on an irregular ground surface S. The tubular legs 18 of an upper scaffold unit 16 are connected to the aligned legs 18 of the adjacent lower scaffold unit 16 by steel rods or smaller tubes which extend within the tubular legs at the joints and are secured by bolts (not shown).

A vertically adjustable platform 30 is supported by the scaffold assembly 15 by a series angular brackets 32 which are adjustably mounted on the vertical legs 18 nearest to the building wall 12. The platform 30 supports the workers who are constructing or finishing the wall 12 at a selected elevation relative to the wall.

In accordance with the present invention, a scaffold extension and enclosure system 40 includes a series of horizontally spaced tubular metal frames 42 each of which has a short leg member 43 and a long leg member 44 rigidly connected by an inclined frame member 46, preferably positioned at an angle A of about 30° relative to a horizontal plane P. As apparent from FIG. 2, the short leg member 43 of each frame member 42 is formed as in integral part of the inclined frame member 46 by bending the steel tubing, and the upper end of the leg member 44 is welded to the inclined frame member 46. The leg members 43 and 44 of each frame 42 align vertically with corresponding legs 18 of the underlying scaffold unit 16, and the lower end portion of each leg member 43 and 44 includes an expanded female socket connector 49 which receives the upper end portion of the corresponding leg 18 and is preferably secured to the leg 18 by a screw with a hand rotatable knob 52. Thus each frame 42 of the enclosure system 40 is supported in a vertical plane by the corresponding scaffold unit 16 underlying the frame 42.

Figure 3:
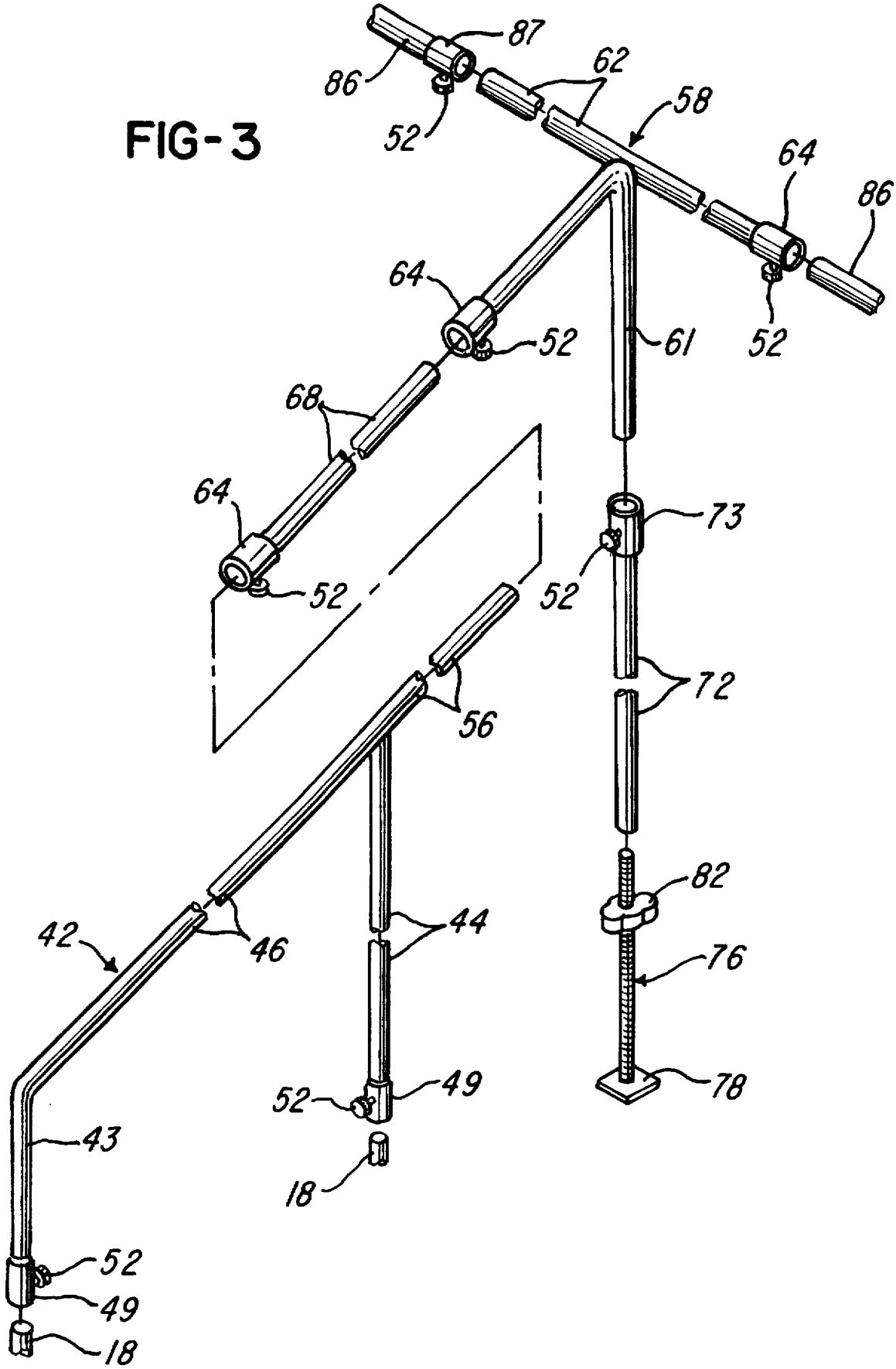
FIG. 3 is an exploded perspective view of the tubular metal frame components shown in FIGS. 1 and 2.

As shown in FIGS. 1–3 the inclined frame member 46 of each support frame 42 includes a projecting upper end portion 56 which is connected either directly or indirectly to a corresponding ridge member or connector 58. Each ridge connector 58 is formed of steel tubing and includes an angular V-shaped tube 61 (FIG. 3) welded to a horizontal tube 62, and each tube 61 and 62 has an expanded end portion or socket connector 64 which receives a fastening screw extending from a corresponding knob 52. A tubular steel extension frame member 68 (FIGS. 2 and 3) may be used to connect the upper end portion 56 of each frame member 46 to the angular tube 61 of the corresponding ridge connector 58. Each extension member 68 also includes an expanded end portion or tubular socket 64 for receiving the upper portion 56 of the frame member 46. The extension member 68 is provided in different lengths, for example, in lengths of 1", 2" and 4" and may be used at different locations in the enclosure system. Each extension portion 56 may sometimes be connected directly to the angle member 61 of the corresponding ridge connector member 58.

As shown in FIGS. 1–3, each ridge connector 58 is supported by a vertical tubular steel post member 72 which has an expanded upper end portion 73 with a threaded fastener having a knob 52 for releasably connecting the post member to the vertical portion of the angle member 61. The lower end portion of each post member 72 receives the upper end portion of an adjustable screw jack 76 which is constructed the same as the screw jacks 27 mentioned above. Each screw jack 76 has a base plate 78 which may seat on the roof 13 or seat on a clamping member in the form of a wood 2"×8" (not shown) which extends the length of the roof 13. The jack 76 also includes a vertically adjustable nut 82 which forms a seat for the lower end of the post member 72.

As shown in FIG. 1, the ridge members 58 are connected by tubular steel horizontal support members 86 each of which has an enlarged or expanded end portion 87 (FIG. 3) and a threaded fastener with a knob 52 for receiving the unexpanded end portion of an adjacent ridge connector tube 62. The horizontal support members 86 form a rigid connection of all of the frames 42 and cooperate with the frames and post members 72 to stabilize the scaffold assembly 15. As also shown in FIGS. 1 and 2, a translucent or transparent flexible cover 90 of extruded plastics film material extends over the frames 42 and connecting support members 86 to form a protective cover for the scaffold assembly 15 and the men working on the platform 30. As shown in FIG. 2, the upper edge portion of the protective cover 90 projects inwardly on the floor or roof 13, the base plates 78 of the jacks 76 or under the clamping board (not shown) which clamps the edge portion of the cover film to the floor or roof 13.

Figure 4:
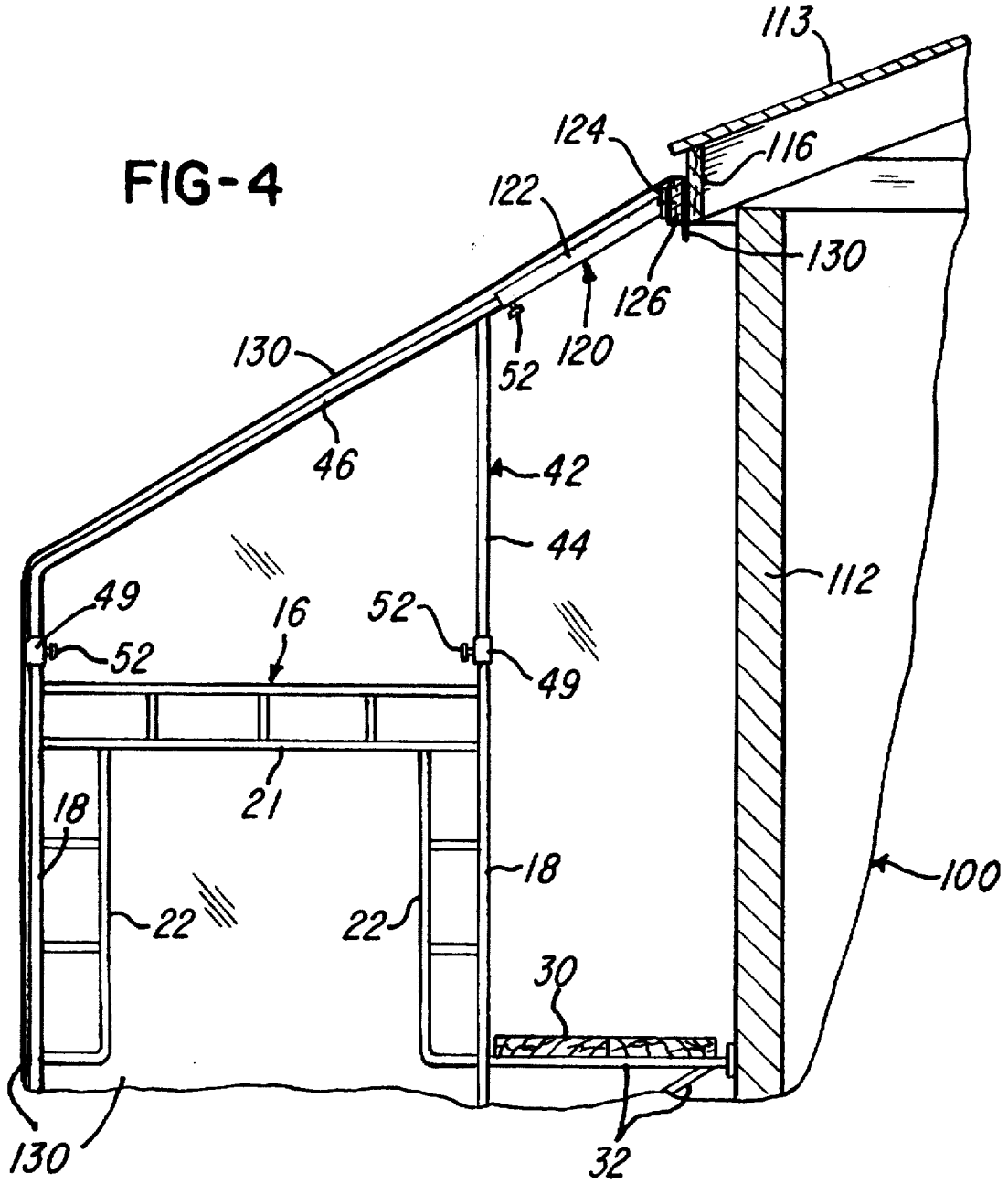
FIG. 4 is a fragmentary end elevational view similar to FIG. 2 and showing a scaffold assembly and enclosure system constructed in accordance with a modification of the invention for use with another type of building.

FIG. 4 illustrates another embodiment of a scaffold extension and enclosure system of the invention in use with a building 100 including an exterior wall 112 and a pitched roof 113. The roof 113 includes an eave portion terminating with a vertical fascia board 116. In this modification, the upwardly projecting extension portion 56 of each tubular metal frame 42, is connected directly to the fascia board 116 by a corresponding roof connector 120. Each of the roof connectors 120 includes a tubular steel member 122 having an inside diameter slightly greater than the outside diameter of the tubular frame member 46 so that it telescopically receives the upper end portion 56. The tubular member 122 is welded to a base plate 124 at an angle of about 60°, and the base plate 124 is secured to a 2"×4" wood board or clamping member 126 temporarily secured to the fascia board 116. A flexible protective cover 130, such as a transparent or translucent plastic film or "Visqueen" film, has its upper edge portion clamped between the member 126 and the fascia board 116 so that any water or snow which drains or moves from the roof 113 onto the cover 130 flows down the inclined portion of the cover 130 and to the ground outward of the scaffold assembly 15. Each of the tubular sections or members 122 carries a threaded fastener with a knob 52 to provide for adjusting the position of the connector 120 on the frame 42 according to the spacing between each frame 42 and the fascia board 116.

From the drawings and the above description, it is apparent that a scaffold enclosure system constructed in accordance with the invention provides all of the desirable features mentioned above. For example, the modular enclosure system may be quickly and conveniently installed on a conventional scaffold assembly 15, accommodates different types of buildings and roof constructions and is effective to shed rain and snow onto the ground outward of the scaffold assembly. The enclosure system also provides a protective enclosure for the people working on the scaffold platform 30 to construct or finish the building side wall. That is, the angle of the inclined frame members 46 prevents water or snow from collecting in pockets formed within the cover 90 or 130. The system further protects the workmen against rain, wind and direct sunlight while providing for illumination of the enclosed space which may be heated. The enclosure system of the invention also connects the scaffold assembly 15 to the building for stabilizing the scaffold assembly, and the modular tubular components of the enclosure system may be conveniently transported and stored in a compact space.

While the form of enclosure system herein described constitutes a preferred embodiment of the invention, it is to be understood that the invention is not limited to this precise form of enclosure system, and that changes may be made therein without departing from the scope and spirit of the invention as defined in the appended claims.

The invention having thus been described, the following is claimed:

1. A protective scaffold enclosure system adapted to be positioned adjacent a building, said system comprising a plurality of horizontally spaced scaffold units each having a pair of vertical legs, a set of tie members rigidly connecting said legs of adjacent said scaffold units, a corresponding plurality of horizontally spaced cover support frames each including a short leg member and a long leg member generally aligned with said vertical legs of the corresponding said scaffold units, each of said cover support frames also including an inclined cover support member rigidly connecting the corresponding said leg members, means for releasably connecting said leg members of each said cover support frame to the corresponding said legs of said scaffold units with said leg members projecting upwardly from said legs, a corresponding plurality of ridge connectors for said cover support frames, means releasably connecting each of said ridge connectors to the corresponding said inclined cover support member of the corresponding said cover support frame, a corresponding plurality of generally vertical post members having upper portions releasably connected to the corresponding said ridge connectors and having bases adapted to be supported by a floor of the building, a plurality of generally horizontal cover support members extending laterally of said cover support frames and releasably connecting said ridge connectors for adjacent said cover support frames, a flexible cover extending over said cover support frames and said ridge connectors and said horizontal cover support members and projecting downwardly over said scaffold units, and said flexible cover having a generally vertical upper portion extending downwardly from said ridge connectors and said horizontal cover support members adjacent said post members.

2. An enclosure system as defined in claim 1 wherein each of said ridge connectors includes a vertical leg portion releasably connected to the corresponding said post member and an inclined leg portion releasably connected to said inclined cover support member of the corresponding said cover support frame, and a horizontal cover support tube rigidly connected to said leg portions of each of said ridge connectors.

3. An enclosure system as defined in claim 1, wherein said bases of said post members comprise screw jacks, and said flexible cover has an upper edge portion extending under said screw jacks.

4. An enclosure system as defined in claim 1 wherein each of said inclined support members of each said cover support frame is linear and forms an angle of about thirty degrees with a horizontal plane.

5. An enclosure system as defined in claim 4 wherein each of said inclined cover support members comprises a metal tube bent to form said short leg member.

6. An enclosure system as defined in claim 5 wherein said long leg member of each said cover support frame is welded to said metal tube and extends parallel to the corresponding said short leg member.

7. A protective scaffold enclosure system adapted to be positioned adjacent a building, said system comprising a plurality of horizontally spaced scaffold units each having a pair of vertical legs, a set of tie members rigidly connecting said legs of adjacent said scaffold units, a corresponding plurality of horizontally spaced cover support frames each including a short leg member and a long leg member generally aligned with said vertical legs of the corresponding said scaffold units, each of said cover support frames also including a linear cover support member connecting the corresponding said leg members and extending at an incline of about thirty degrees, means for releasably connecting said leg members of each said cover support frame to the corresponding said legs of said scaffold units with said leg members projecting upwardly from said legs, a corresponding plurality of ridge connectors for said cover support frames, coupling means releasably connecting each of said ridge connectors to the corresponding said inclined cover support member of the corresponding said cover support frame, a corresponding plurality of generally vertical post members having upper portions releasably connected to the corresponding said ridge connectors and supported by screw jacks adapted to rest on a floor of the building, a plurality of generally horizontal cover support members extending laterally of said cover support frames and releasably connecting said ridge connectors for adjacent said cover support frames, a flexible cover extending over said cover support frames and said ridge connectors and said horizontal cover support members and projecting downwardly over said scaffold units, and said flexible cover having a generally vertical upper portion extending downwardly from said ridge connectors and said horizontal cover support members adjacent said post members and having an edge portion extending under said screw jacks.

* * * * *